United States Patent [19]

Durr et al.

[11] 4,218,285

[45] Aug. 19, 1980

[54] METHODS OF PULP-INSULATING A CONDUCTOR

[75] Inventors: Helmut E. Durr, Dunwoody; James G. Wright, Jr., Roswell, both of Ga.

[73] Assignee: Western Electric Company, Inc., New York, N.Y.

[21] Appl. No.: 951,808

[22] Filed: Oct. 16, 1978

[51] Int. Cl.[2] ..... B05D 3/06; B05D 5/12

[52] U.S. Cl. ..... 162/106; 427/55; 427/118; 427/120

[58] Field of Search ..... 162/106; 427/118, 120, 427/55; 156/51; 174/121 B, 121 SR

[56] References Cited

U.S. PATENT DOCUMENTS

| | | | |
|---|---|---|---|
| 1,615,375 | 1/1927 | Gill | 162/106 |
| 1,615,418 | 1/1927 | Walker et al. | 162/106 |
| 1,615,422 | 1/1927 | Walker et al. | 162/106 |
| 1,945,538 | 2/1934 | Schwartz | 162/135 |
| 2,187,391 | 1/1940 | Borgeson | 174/121 R |
| 2,191,584 | 2/1940 | Pohler | 427/120 X |
| 2,440,802 | 5/1948 | Krogel | 162/106 |
| 2,934,458 | 4/1960 | Budd et al. | 65/3 B |
| 3,250,641 | 5/1966 | Kersker et al. | 427/55 |
| 3,521,375 | 7/1970 | Sanders, Jr. | 34/44 |
| 3,595,720 | 7/1971 | Ames et al. | 156/51 |
| 3,737,982 | 6/1973 | Calhoun et al. | 29/573 |
| 3,763,554 | 10/1973 | Early | 156/51 X |
| 4,113,534 | 9/1978 | Pound et al. | 162/106 X |
| 4,125,645 | 11/1978 | Jukes et al. | 162/106 X |

FOREIGN PATENT DOCUMENTS

| | | | |
|---|---|---|---|
| 1401931 | 8/1975 | United Kingdom | 156/51 |

OTHER PUBLICATIONS

RHOPLEX ®, Acrylic Emulsions for Bonding Wet--Laid Non-Woven Fabrics, Paper Chemicals Technical Bulletin, Rohm and Haas Company, 1978.

RHOPLEX ®, Acrylic Emulsions for Paper Saturation, Paper Chemicals Technical Bulletin, Rohm and Haas Company, 1978.

Casey, *Pulp and Paper*, Second Edition, vol. 2, Interscience Publishers, 1961, pp. 668–671.

*Pulp and Paper Sciences and Technology*, vol. 2, McGraw-Hill Book Co., 1962, p. 250.

Britz et al., "Manufacturing Pulp Cable", *The Western Electric Engineer*, Jul.–Oct. 1971 issue, pp. 86–94.

"Products News-It's Happening at the Cable Plant", *Microphone* (Western Electric Hawthorne Works), Sep. 1978, vol. 48, No. 8, p. 10.

*Primary Examiner*—Richard V. Fisher

*Attorney, Agent, or Firm*—E. W. Somers

[57] ABSTRACT

A coating (28) is applied over an advancing electrical conductor (21) and partially dried by exposing it to a first temperature for a predetermined time. This renders the coating substantially insoluble in water so that it is retained on the conductor as the conductor is moved through apparatus (34) which forms a ribbon (35) of pulpous material longitudinally with the conductor. The ribbon is reshaped into an insulative cover (41) concentrically disposed about the coated conductor, after which the pulp-insulated conductor is exposed for a predetermined length of time to a second temperature which is substantially greater than the first temperature. This reduces substantially the moisture content of the pulpous material and simultaneously tackifies the coating which cause the pulp insulation to have excellent crush resistance and adheres the pulp insulation to the conductor to form an insulation cover having substantial integrity.

9 Claims, 13 Drawing Figures

METHODS OF PULP-INSULATING A CONDUCTOR

TECHNICAL FIELD

This invention relates to methods of for pulp-insulating conductors. More particularly, it relates to a conductor coating which is capable of being treated to permit a pulpous material to be applied thereover in a continuous process and which when further treated causes the pulpous material to form pulp insulation having substantial integrity.

BACKGROUND OF THE INVENTION

One of the principal insulation materials for conductors used in telephone communication systems is a pulpous material which is made by converting sheets of dry wood pulp to a pulp and water slurry and which has acceptable dielectric properties at voice frequencies. Pulp insulation, because of the inherent nature of the pulpous material tends to absorb moisture to which a cable may be exposed, thereby avoiding degradation of transmission signals. Water which enters a pulp-insulated multipair cable causes the pulp to swell, which localizes the water at a fault point. Routine tests based on electrical discontinuities caused by the wet pulp are then employed to accurately locate the fault.

Pulp-insulated cable advantageously is low in cost, has a fail safe nature which allows group location of defects caused by failures in cable jackets and provides more conductors for a given cable diameter than other kinds of cable. Another advantage in today's world is the continuing availability of wood pulp as opposed to the increasing dependence on sources for a petroleum derivative from which plastic insulating materials are made.

Pulp-insulated conductors are generally produced in a continuous process in which many conductors, often as many as sixty, are passed through an electrolytic cleaner, coated with a wet pulp layer, and drawn through a drying oven in order to produce a pulp-insulation cover having a final moisture content in the range of 7 to 10% on each of the conductors. A detailed description of a pulp-insulating process can be had by referring, for example, to an article "Manufacturing Pulp Cable", on pages 86–94 of the July–October 1971 issue of *The Western Electric Engineer.*

One of the problems in pulp-insulated conductors is the occurrence of uninsulated areas along the conductors, particularly in the final cable structure. Uninsulated portions of 0.32 cm or less are called "chips"; 0.95 cm or less, "shorts"; and 0.95 cm or greater, "bare wire". These may occur either because of a lack of adherence of the pulp to the conductor during insulating or because of the abuse to which the insulation is subjected in steps of a cable-making process subsequent to insulating. Conductors which have a predetermined number of such defects occupy a part of and increase the size of the cable cross-section without contributing to its utility since they are unuseable for telecommunications. Unfortunately, an increased cable cross-section requires additional plastic jacketing material and underground duct capacity without any offsetting benefit.

Another problem relates to the strength characteristics of pulp insulation and the effects of these on the electrical properties of pulp-insulated conductors. A pulp-insulated conductor emerging from a final drying chamber has a substantially circular cross-sectional configuration. When two such insulated conductors are associated together to form a twisted pair, their centers are separated by a distance which has an inversely proportional effect on mutual capacitance. Because the crush resistance or compressive strength of conventional pulp-insulation having a residual moisture content is relatively low, one or both of the conductors may have its insulation deformed when subjected to the rigors of other manufacturing processes such as, for example, twisting. This generally causes the distance between conductor centers to be decreased with an accompanying undesirable increase in mutual capacitance. While this problem could be overcome by reducing the residual moisture content, the resulting pulp insulation has been found to have unacceptable flexibility endurance characteristics.

If the foregoing problems were to be overcome, pulp, because of its advantages, could possibly become more attractive for conductor insulating in the telecommunications industry. Moreover, if the foregoing problems were to be overcome, savings could be realized on jacketing material and duct space since an extremely high percentage of the conductors in a cable would be usable, thereby obviating the need to provide spare pairs to guarantee a predetermined number of usable ones.

In the prior art, C. J. Krogel, in U.S. Pat. No. 2,440,802, shows a method in which a wire is coated with a water emulsion of polyvinyl acetate, polyvinyl alcohol or methyl methacrylate and moved through a vat of water-pulp slurry. See also U.S. Pat. No. 1,615,422, issued to H. G. Walker et al.

What the prior art seemingly fails to show or teach is a suitable process for pulp-insulating conductors which insures consistent integrity of the insulative covering on the conductor. Such a process should permit the pulp to be treated in such a way as to optimize its resistance to deformation in subsequent processing and during installation to preserve acceptable mutual capacitance properties, without causing the pulp to become brittle and impair the integrity of the insulative cover.

SUMMARY OF THE INVENTION

The foregoing problems have been overcome by a method of making a pulp-insulated electrical conductor in accordance with this invention which includes the step of enclosing an electrical conductor in a coating which is capable of being treated to render the coating substantially insoluble in water, and which when covered with pulpous material comprising a water-pulp mixture is capable of being further treated to create an adhesive bond between said pulpous material and said conductor. The electrical conductor which is enclosed in said coating is treated to render the coating substantially insoluble in water after which the electrical conductor and said coating are enclosed in a pulpous material having a relatively high moisture content and being disposed substantially concentrically about the conductor. The coating and said pulpous material are treated to reduce substantially the moisture content of the pulpous material and to tackify the coating which cause the crush resistance to be increased so that it remains substantially concentrically disposed about the conductor and which cause the pulpous material to adhere to the conductor to form an insulative cover having substantial integrity.

More specifically, a conductor is advanced from a supply and is coated with a formable material such as, for example, an aqueous emulsion of acrylic latex polymer which cures when subjected to heat. The coated conductor is exposed to a predetermined temperature for a predetermined length of time which causes the emulsified latex to be partially cured, so that it is essentially non-tacky and substantially insoluble in water. This permits the coated conductor to be advanced about equipment without transferring the coating to the equipment and to be moved about a cylinder mold in a vat of water pulp slurry which embeds the conductor in a ribbon of pulpous material without any loss of the coating in the vat. The coated, pulp-insulated conductor is moved through a polisher wherein the ribbon is formed into a cover which is concentrically disposed about the conductor. After that, the coated, pulp-insulated conductor is exposed for a predetermined time to a second temperature that is substantially greater than the first to further cure the coating and to tackify it. The pulp is dried by causing the water to be drawn therefrom so that the moisture content is substantially reduced which causes the crush resistance of the pulp to be increased to prevent deformation thereof. Advantageously, the further curing causes adhesion of the dried pulp to the conductor to form an insulative cover having substantial integrity.

BRIEF DESCRIPTION OF THE DRAWINGS

Other features of the present invention will be more readily understood from the following detailed description of specific embodiments thereof when read in conjunction with accompanying drawings, in which.

DETAILED DESCRIPTION

Figure 1:
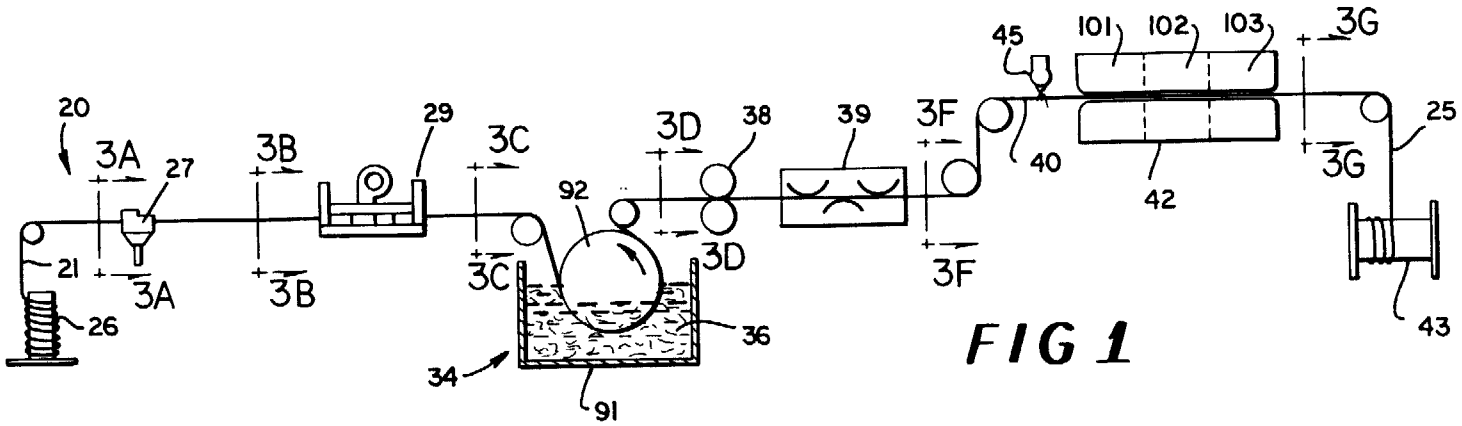
FIG. 1 is an overall schematic view of an apparatus for carrying out the methods of this invention to pulp-insulate a conductor.
Figure 2:
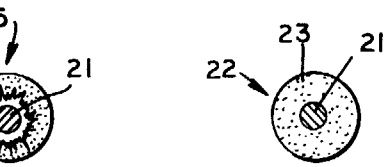
FIG. 2 is a cross-section end view of a pulp-insulated conductor which is made by the prior-art methods.

Referring now to FIG. 1, there is shown an apparatus, designated generally by the numeral 20, for carrying out a process in accordance with this invention for pulp-insulating a copper conductor 21. A pulp-insulated conductor 22 which is manufactured in accordance with prior art methods is shown in FIG. 2 and includes the copper conductor 21 enclosed in a concentric sheath of pulpous insulation 23. The deficiencies of the conventional pulp-insulated conductor 22 are overcome by a pulp-insulated conductor 25 which is made in accordance with this invention.

Figure 3D:
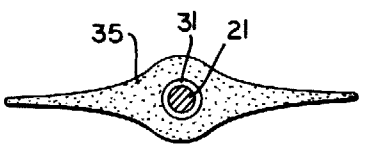
FIGS. 3A–3G are a sequence of views showing a cross-section of the conductor at various stages in its manufacture with the apparatus shown in FIG. 1.
Figure 3G:
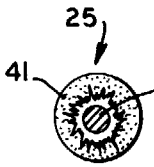
Figure 3C:
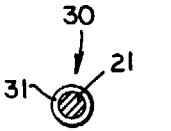
Figure 3F:
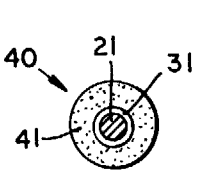
Figure 3B:
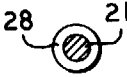
Figure 3A:
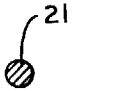

The copper conductor 21 (see FIG. 3(A)) from a supply 26 is advanced through a device 27 which applies a coating 28 to the conductor (see FIG. 3(B)) that is dried partially in an oven 29 to form a coated conductor 30 comprising the conductor 21 enclosed in a layer 31 (see FIG. 3(C)). The coated conductor 30 is moved through a conventional cylinder type pulp apparatus 34 where it is centered in a wet ribbon 35 (see FIG. 3(D)) of pulpous stock 36 which is being formed continuously. After the ribbon 35 and the conductor 21 are moved out of the apparatus 34, they are moved between press rolls 38-38 which apply compressive forces to the composite ribbon 35 and conductor 30 to reduce the moisture content of the pulpous material 36. Then the ribbon 35 is spun about the conductor (see FIG. 3(E)) by a polisher 39 to form a pulp-covered conductor 40 (see FIG. 3(F)) which comprises a tube 41 of pulp insulation 36. The pulp-covered conductor 40 is moved through an oven 42 in which the coating 31 and the pulp insulation undergo further changes (see FIG. 3(G)), and is then taken up on a reel 43 for use in subsequent operations. It should be understood that while some parts of the apparatus are described for pulp-insulating a single copper conductor 21, the apparatus is generally used to pulp-insulate simultaneously a plurality of conductors, such as, for example, sixty.

The composite insulation, which includes the coating layer 31 and the pulp tube 41 and which is formed over the copper conductor 21, must have sufficient mechanical properties to withstand the rigors of pair twisting, unit stranding, cable, sheathing, shipping and installation. Dielectric properties of the composite pulp insulation must be such that twisted pairs of the insulated conductors 25-25 meet the requirements for mutual capacitance, capacitance deviation of pairs, pair-to-pair capacitance unbalance, capacitance unbalance-to-ground, dielectric breakdown, and insulation resistance.

Preceeding the insulating step in prior art processes, the uninsulated conductors 21-21 were passed through an electrolytic cleaner which was required in order to assure suitable adhesion of the pulp to the conductors and to keep paper-forming equipment from becoming clogged. See the priorly identified issue of the *Western Electric Engineer*. High current at a low voltage was applied to the copper conductors as they were passed through the cleaner and an electrolyte provided a violent scrubbing action to assist in the cleaning of the wire. Advantageously, it has been found that this cleaning step is not required in the process which embodies the principles of this invention.

Going now to a more detailed description of the operation of the apparatus 20 to carry out the steps of the invention, each of the conductors 21-21 is coated with a material 28 which is at least capable of bonding the pulpous material 36 to the conductor 21. The prior art such as, for example, hereinbefore identified patents to H. G. Walker et al and C. J. Krogel, discloses the use of an adhesive. It has also been thought that a latex adhesive, pulpous mixture could be introduced into facilities which hold the pulpous slurry. However, conductors 21-21 insulated with such a mixture have not successfully resisted the longitudinal flow of water, probably because the latex coated the fibers thereby preventing the fibers from absorbing moisture when they were coated on the conductors.

The material 28 which is used in the process of this invention must be such that when initially treated, such as, for example, by exposure to a first temperature for a predetermined time, it becomes capable of remaining on the conductor 21 while a pulpous material is applied thereover, and when further treated, such as, for example, by exposure to a second temperature for a predetermined time, it creates an adhesive bond between the pulpous material and the conductor.

The material 28 which is used to coat the conductor 21 is partially curable at a relatively rapid rate by exposing it to a predetermined temperature for a predetermined time. It is especially important that the coating 28 is capable of being only partially cured because once fully cured, it would not adhere to nor further react with the pulpous material which is applied subsequently to the conductor. Once the material 28 begins to cure, its dispersion capability or solubility is drastically reduced. Also, the material 28 should be capable of being partially cured to render it substantially insoluble in water to prevent its removal from the conductors 21-21 as they are advanced through the water-pulp slurry in the apparatus 34. Because of the line speed and the thickness of the coating 28, some portions of it such as, for example, those adjacent the conductor may not be cured as much as others.

Further, the coating material must be such that when initially treated, e.g. when it is partially cured, it is essentially non-tacky so that it does not peel off the conductor 21 when, for example, the conductor is moved into and out of engagement with portions of the apparatus 20. If the coating material did not possess this quality, it would transfer from the conductor 21 onto the cylinder apparatus 34, for example, and eventually block the movement of pulpous material through the screened cylindrical surface, thereby impairing the deposition of ribbons.

It has been found that an acrylic adhesive, and, more particularly, an aqueous emulsion of an acrylic latex polymer is ideal for purposes of this invention. As the percent moisture is reduced, the polymer chains are lengthened, come into closer proximity with each other, and are reoriented to form a stable three dimensional network. Other ingredients are present in the emulsion to control the reaction. An aqueous emulsion has been found specially suitable since it facilitates the cleaning of the equipment, there is no need to be concerned about other solvents, and it is compatible with the pulp stock system.

An ethyl acrylate-methyl acrylate copolymer such as that marketed by Rohm and Haas Company under the designation HA-12 and having a solid content of 45% has been found to be especially suitable. It is nonionic and cross-linkable with the cross-linking capable of being controlled so that water insolubility can be realized while remaining essentially non-tacky. Another acrylic latex material such as, for example, HA-16 from Rohm and Haas is also acceptable. The use of a cross-linking acrylic polymer as a coating material which has as one of its functions the adhesion of a pulpous material to a conductor may be somewhat unusual in that these polymers are customarily used in textile applications such as, for example, fabric finishing and backcoating. See for example, Rohm and Haas brochure published 1978 covering RHOPLEX® HA-12 and HA-16.

Figure 4:
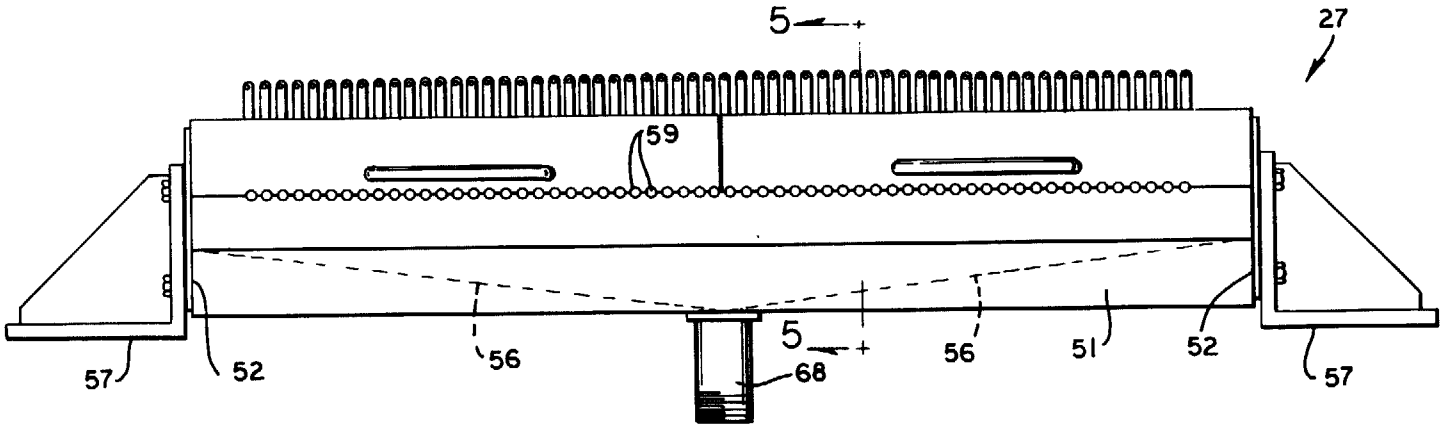
FIG. 4 is an end view of a device for applying a coating to each of a plurality of conductor prior to each being enclosed in a cover of pulpous stock.
Figure 5:
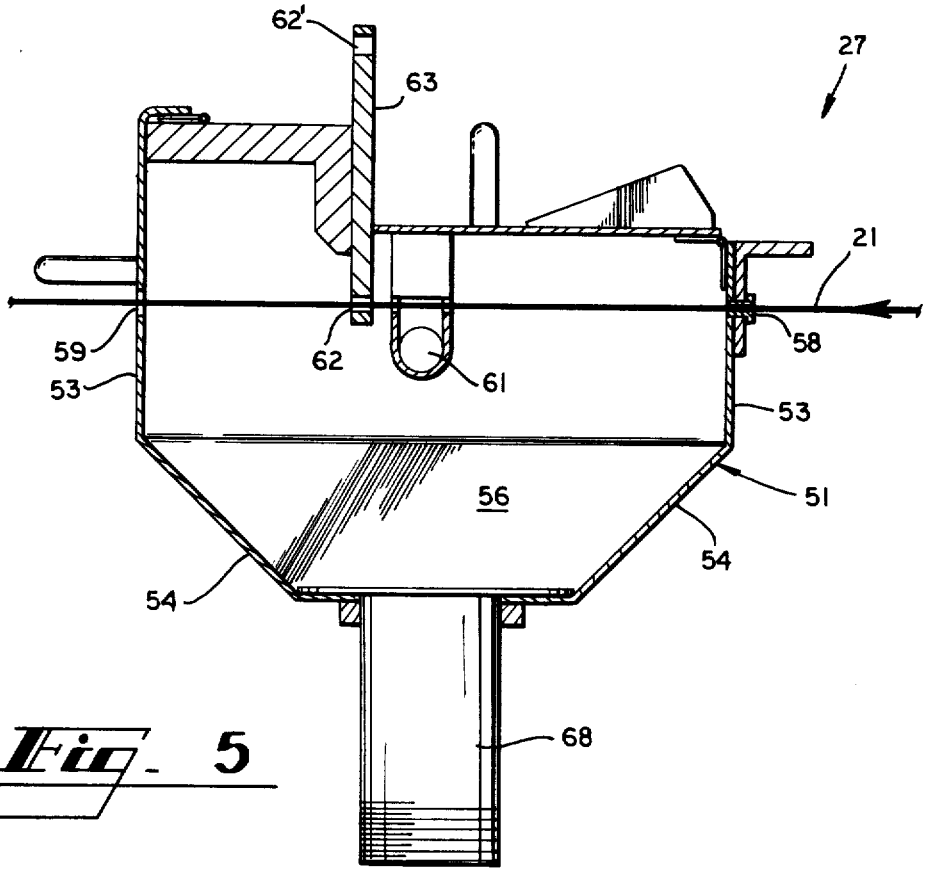
FIG. 5 is a cross-sectional view in elevation of the device shown in FIG. 4.

In the device 27 for applying the coating 28 of an aqueous emulsion of acrylic latex to a plurality of conductors 21-21, a container 51 (see FIGS. 4 and 5) includes side walls 52-52, end walls 53-53 and sloping bottom plates 54-54 and 56-56. As can best be seen in FIG. 4, the container 51 is supported along each side on mounting brackets 57-57.

The container 51 includes a plurality of entrance openings 58-58 and exit openings 59-59 through associated ones of which the plurality of conductors 21-21 extend. As can best be seen in FIG. 5, the conductors 21-21 extend above a conduit 61 which bubbles the emulsified acrylic latex into engagement therewith. Then the coated conductors 21-21 are advanced through openings 62-62 in a sizing die 63 positioned in a depending leg 64 of a plate 66 which is attached to the top of the container and which extends into the container. Excess coating material falls to the bottom of the container 51, flows by gravity along the inclined bottom plates 54-54 and 56-56, and is collected in a drain 68 for return to a supply to be reused.

Figure 6:
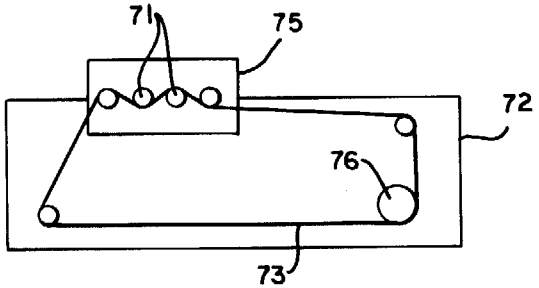
FIG. 6 is an end view of an alternative embodiment of a portion of the device shown in FIG. 4.

In an alternative embodiment, after each of the conductors 21-21 is coated with the emulsified acrylic latex, the conductors are passed through associated dies 71-71 (see FIG. 6) which are mounted in a downstream wall 72 of the tank 51. For convenience of illustration only four dies are shown, but it should be apparent that as many dies are used as there are conductors. The dies 71-71 which are effective to control the amount of latex which is applied to each of the conductors 21-21 are caused to rotate by a belt 73 which is common to all the dies, which passes over idler pulleys 74-74, and which is advanced by a motor drive 76. The rotation of the dies 71-71 advantageously causes the conductors 21-21 to be wiped to equalize the latex adhesive on each and to insure that the dies are not clogged by dried latex.

In another alternative embodiment, the dies 71-71 may be mounted for rotation at a slight angle to the paths of the conductors 21-21 to provide a spiral coating on the conductors 21-21. Since one side of each non-rotating conductor 21 will be in contact with a die 71 at a given instant, the coating will be applied on the opposite, non-contacting side where a larger clearance occurs. By properly sizing the dies 71-71 relative to the conductor gauge and by the choice of the rotational velocity of the dies, the coating may be applied in a volume which is small enough to effect substantial material savings while still being large enough to cause suitable adhesion of the pulpous material 36 to the conductors 21-21.

After the conductors 21-21 have been coated with a layer of an aqueous emulsion of acrylic latex, they are advanced through the oven 29, which is designed to partially dry the latex. The partial drying of the latex or other suitable coating material will cause a removal of the solvent or carrier and for the latex will initiate a curing process which includes a semi cross-linking of the molecule chains within it.

Figure 7:
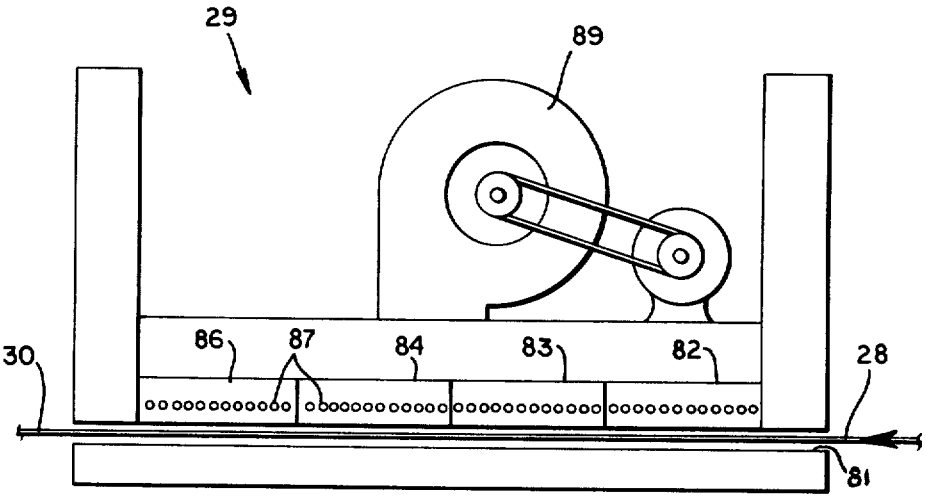
FIG. 7 is a view of an infra-red oven used to partially dry the coating.

Referring now to FIG. 7, the oven 29 includes an entrance 81 for the sixty conductors 21-21 and multiple heating banks, such as, for example, four banks designated 82, 83, 84, and 86. Each of the heating banks 82, 83, 84, and 86 includes twelve infra-red lamps 87-87 which partially dry the latex as the conductors 21-21 are advanced beneath them to form coated conductors 30-30 (see FIG. 3(C)) each of which is enclosed with a partially cured layer 31. For a discussion of the use of infra-red heat, see U.S. Pat. Nos. 3,250,641 and 3,521,375. While infra-red heating is used in a preferred embodiment of this invention, it should be understood that other apparatus may be used to accomplish this step in the inventive process to provide a first temperature to which the coated conductors are exposed. Ventilation for the oven 29 is provided by a fan 89. The temperature in the oven 29 is in the range of about 260° C. to 370° C. with the higher temperatures required for the larger gauge sizes.

After having passed below the fourth and final bank 86 of infra-red heat lamps 87-87, the conductors 21-21 are moved out of the oven 29 so that an insulative cover of pulpous material may be formed about each. Advantageously, the coated conductors 21-21 are exposed for a predetermined time to the first temperature such that enough reactive sites remain to facilitate further cross-linking. At the same time, the partial curing is such as to render the coating 31, which has a thickness of about 0.005 mm, substantially insoluble in water.

From the infra-red oven 29, the conductors 30-30 are moved into the single cylinder paper-forming apparatus 34 where refined pulp is continuously metered into a vat 91 or forming section of the apparatus. In a pulp preparation system (not shown), raw material in the form of sheets of dry wood pulp are converted to a pulp and water slurry or stock which is suitable for use by the pulp-insulating apparatus 20. See, for example, the priority identified issue of *The Western Electric Engineer*.- Pulp includes a mass of fibrous cellulose material in which the fibers are interlocked together with strength derived from hydrogen bonding in which a bond is created between hydrogen and oxygen molecules of the cellulose material. See Casey, J. P., *Pulp and Paper Chemistry Technology*, Vol. 2, 1961 Interscience Publishers N.Y. and *Pulp and Paper Science and Technology*, Vol. II Paper, published 1962 by McGraw-Hill Book Company. In the preparation process, water serves as a supporting medium for the fibers during refining in which fibers are mechanically worked to alter the fiber structure. The fibers which comprise the pulpous material or pulp slurry are about 3 to 4 mm in length with a diameter of about 0.025 mm. The pulp slurry which is supplied to the vat comprises about 98% by weight of water and about 2% by weight of pulp with traces of other ingredients.

In the vat 91, the pulp is further diluted with water to a predetermined consistency, i.e. percentage by weight of fiber in combination of fiber and water, and formed into ribbons 35-35 by straining pulp fibers through a wire screen on a rotary cylinder mold 92 under a relatively small pressure differential. The rotating cylinder mold 92 or forming screen, as it is called in the art, is divided into sixty narrow uniform sections extending about the circumference. These sections are separated by alternate strips, painted-on plastic material, which block the flow of water and prevent the deposition of fibers. The ribbons 35-35 of pulp are formed only on the unpainted areas of the cylinder mold 92 and the conductors 30-30 are guided so that one conductor is embedded in the center of each ribbon as formed (see FIG. 3(D)). After forming, the wet, paper-pulp ribbons 35-35 with the adhesively coated embedded conductors are transferred from the cylinder mold 92 to a continuous fabric belt (not shown) and passed through the pair of rubber-covered press rolls 38-38 where the excess water is removed to reduce the moisture content of each of the pulp ribbons 35-35 to about 70%. The ribbons 35-35 which are moved out of engagement with the press rolls 38-38 are about 0.79 cm wide and form an insulation thickness that varies from 0.18 to 0.41 mm depending on conductor size.

Figure 3E:
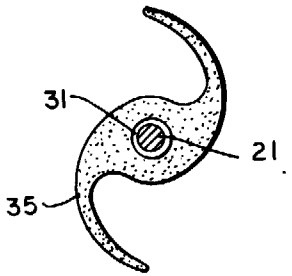

Then a plurality of the wet ribbons 35-35 having the conductors 30-30 embedded therein are turned around the conductors (see FIG. 3(E)) by passing them through the high speed rotating polisher 39 (see FIG. 1), which is conventional in the art, to form a layer 41 (see FIG. 3(F)) of pulp insulation having a moisture content of about 70%. The conductor 21 enclosed within superimposed concentric layers 31 and 41 of adhesive and pulp, respectively, is designated generally by the numeral 40.

The wet insulation 41 is dried to a final moisture content of about 3 to 6% and the layer 31 is further treated by passing the pulp-insulated conductor 41 through the oven 42 which comprises three heating zones designated 101, 102 and 103. For 26 gauge conductors, for example, the oven 42 has an entrance temperature of about 680° C. in the zone 101, a temperature of about 680° C. in the middle zone 102, and an exit zone temperature of about 540° C. These temperatures which depend on line speed, conductor gauge size and the particular conductor coating 28 are closely controlled to adequately dry the insulation but not burn it. An apparatus for drying pulp insulated conductors is shown in U.S. Pat. No. 3,829,985 issued Aug. 20, 1974 in the names of H. E. Durr et al.

The final oven 42 which dries the pulp and the coating 28 causes the drying to be accomplished in several stages. As disclosed on page 250 of *Pulp and Paper Science and Technology* Vol. II paper 1962 McGraw-Hill, the surface water evaporates and is replaced by water which migrates by capillary action from inside the pulpous layer.

Because of the line speed and the length of the furnace 42, the conductors 21-21 may be in the oven 42 for a time of only about 10 seconds. The short time exposure of the pulp-insulated conductors 21-21 to the above-mentioned temperature causes what may be characterized as an explosion to cause the moisture to be moved rapidly outwardly from the conductors.

As each conductor 21 is advanced through the final oven 42, the partially cross-linked adhesive coating 28 "softens", especially at the interface with the pulp layer 41. The exposure for a predetermined time to the temperatures within the furnace 42 tackifies the layer 31 and permits pulpous material to penetrate into and become adhered thereto (see FIG. 3(G)). Also, there seemingly is a diffusion or migration of portions of the coating material into the pulpous material which is caused as a result of the explosion effect as the conductors 21-21 are moved into the final oven which has a temperature many times greater than that of the ambient atmosphere. The coating 28 penetrates and disperses into adjacent portions of the pulp fiber network of the layer 41 to replace some of the water which is pulled out during the drying and which tends to bond together adjacent fibers. This results in a pulp-insulated conductor 25 in which there is no well-defined interface between the initial latex adhesive layer 31 and the pulp layer 41, but rather an apparent intermingling thereof for some distance into the pulp 36 (see FIG. 3(G)). Advantageously, the invention provides a pulp-insulated conductor 25 having greatly improved crush resistance and flexibility endurance thereby assuring substantial insulation integrity and avoiding the formation of bare wire during the subsequent processes to which the pulp-insulation is subjected.

A secondary or tertiary vehicle for the movement of portions of the coating 31 into the pulp 36 is the behavior of the pulp itself. As the pulpous material is formed into a ribbon 31 on the cylinder 29, it is saturated. Following pressing and during drying water is squeezed or pulled out of the pulpous sheath thereby providing pores for the receipt of additional water which the pulp absorbs from the partially cured adhesive. As this occurs, the water carries with it across the boundary portions of the adhesive which strengthens the pulpous mass. This occurs because when the conductor 21 with the latex adhesive 28 is advanced through the vat 91 of pulp, the pulpous material deposited as ribbons on the cylinder mold begins to cause the partially dried adhesive to become watery so that the pulp begins to absorb the water and thereby begin to cause diffusion of the material across the boundary and into the pulp.

Tests by the method shown in U.S. Pat. No. 3,737,982 issued in the names of J. C. Calhoun and W. C. Flegal on June 12, 1973 show that the temperature of the copper conductors 21—21 during the process of this invention never exceeds 100° C., notwithstanding the movement of the conductors through an oven with a temperature in the range of about 480° C. to 870° C. The partially covered acrylic latex coating 28 tends to be moved toward a surface having a higher temperature than its own. Since the conductor 21 is never higher than 100° C., the coating tends to move toward the ambient temperature within the furnace 42.

The final pulp-insulated conductor 25 effectively has a dual insulation—an intermediate layer 31 covered by pulp-although about the interface there is a region comprising adhesive diffused into the pulp. This is advantageous since the occurrence of "shiners" on the conductor, i.e. the absence of pulp, is not as critical as in the prior pulp-insulation because the adhesive prevents copper-to-copper contact of adjacent conductors which could cause a short.

The thickness, density and amount of moisture in the pulp insulation as it is moved from the oven 42 are important insofar as capacitance requirements of a pulp-insulated cable are concerned. Pulp thickness has an inverse effect of mutual capacitance and excess moisture causes soft pulp which can be easily deformed thus affecting uniform capacitance distribution.

Advantageously, the insulation which is made in accordance with this invention has a lower moisture content than the 7 to 10% of pulp insulation 23 made by prior art processes. When such conductors 22—22 were subjected to the rigors of twisting and stranding, the insulation compacted, causing the conductors to be deformed and eccentric with respect to the insulation thereby decreasing the distance therebetween. This undesirably increased the mutual capacitance between the conductors. While deformation can be substantially prevented by a higher degree of drying of the pulp to perhaps 3 to 6%, the result is an extremely brittle insulation which literally degrades on the conductors during twisting. Dry fibers tend to be brittle, but water-soaked fibers are flexible because they have taken up water which makes them soft and pliable, increases their elasticity and plasticity, and decreases their stiffness.

By the methods of this invention to produce an insulation 41 having superior adhesion to the conductor 21, it has been found that the moisture content can be further reduced to the 3 to 6% range which prevents compacting of the insulation during twisting. The improved flexibility of the insulation 41 notwithstanding the substantially lower moisture content of the pulp over that in conventional processes may be due in part to oxygen molecules of the coating material 28 attaching themselves to the hydrogen molecules in the pulp to form a bond. The capability of maintaining suitable distances between centers of conductor pairs offsets any adverse effect on the dielectric constant by the replacement of any air voids adjacent the conductor by the coating layer 31.

Evidently, the combination of the acrylic latex coating and the almost 50% reduction in average final moisture content results in a superior product. It is of interest to note that conductors which are coated, pulp-insulated and dried to the final moisture content of 7 to 10% of prior art conductors do not resist crushing during twisting operations, for example, unless they are coated and treated in accordance with this invention.

EXAMPLE

A plurality of 26 gauge copper conductors 21—21 having an outside diameter of about 0.4 mm were advanced at a line speed of about 61 meters per minute into the adhesive applicator which applied a coating of ethyl methyl methacrylate to each of the conductors. The coated conductors were advanced through sizing dies which caused the coating to be about 0.013 mm thick on each conductor. The conductors were then moved through an infra-red drying over which included four banks of twelve lamps which were effective at a temperature range of 260° C. to 370° C. to partially dry the adhesive so that as the conductors exited from the oven, the adhesive was about 0.005 mm thick. The smaller the gauge of the conductors, the lower the temperatures of the oven.

The adhesively coated conductors 21—21 were moved around the cylinder 93 in the pulp vat 94 where each conductor was embedded in a ribbon 35 of pulpous material 36 such that the moisture contact of the pulp ribbon was about 80% by weight. The conductors 21—21 were moved between the press rolls 38—38 which caused the moisture content to be reduced to about 70% by weight after which the conductors were moved through the polisher 39 which formed the ribbons 35—35 into concentrically disposed sheaths of pulp insulation.

From the polishers 39—39 the conductors were moved into and through the final oven 42 having three main chambers. Initially, the conductors were exposed to a temperature of 654° C., in the second chamber to a temperature of about 654° C. and in the final chamber to a temperature of about 530° C. For 26 gauge copper conductor having an adhesive coating of about 0.005 mm and at a line speed of about 61 meters per minute, it was found that suitable temperature ranges are from about 615° C. to 685° C. in the initial chamber, 615° C. to 685° C. in the second chamber and from about 525° C. to about 540° C. in the final chamber before exiting. The moisture content of the pulp insulation as the conductors were advanced out of the oven was in the range of 4 to 6% by weight while the diameter-over-dielectric of the pulp insulated conductor was about 0.79 mm. The weight of the insulation was found to be about 184 grams per meter.

Test Results

The results of tests for conductors 21—21 which have been insulated with pulp insulation in accordance with this invention are demonstrably better than those for conductors insulated with pulp by conventional processes. For example, a 26 gauge conductor with conventional pulp insulation had a crush resistance in the range of 63 to 120 newtons and an average value of 98 newtons while insulation made in accordance with this invention had a crush resistance in the range of 76 to 187 newtons and an average value of 125 newtons. A force of less than 6 newtons was required to overcome the adhesion of a predetermined length of conventional pulp insulation from a 26 gauge conductor while 19 newtons were required for the insulation of this invention.

Flexibility endurance of pulp insulation is measured by the number of cycles a length of pulp-insulated conductor can be wound onto and unwound from a mandrel having a predetermined diameter. A sample comprising nine lengths of a 26 gauge conductor insulated by a conventional process withstood an average of 2 cycles before all of the sample displayed bare spots whereas the count increased to an average of 3.3 for conductors insulated in accordance with this invention. For 24 gauge conductors, these values were 2.5 cycles and 3.8 cycles, respectively.

The improvements are even more pronounced with respect to the integrity of the insulation cover on the conductor. For example, at the twisting operation, standard pulp-insulated conductors 22—22 showed 4.5% shorts and 4.0% chips compared to 0.09% and 0.4% for the conductors 25—25. At stranding, shorts occurred at 0.69 per MCF (million conductor feet) for standard pulp conductors versus 0.09 per MCF for the conductors 25—25 whereas shorts at cabling decreased from 0.22 per MCF to 0.037 per MCF. In a final cable produced in accordance with this invention, shorts dropped from 0.53 per MCF to 0 while the number of opens dropped from 0.07 per MCF to 0.04 per MCF.

It is to be understood that the above-described arrangements are simply illustrative of the invention. Other arrangements may be devised by those skilled in the art which will embody the principles of the invention and fall within the spirit and scope thereof.

What is claimed is:

1. A method of making a pulp-insulated electrical conductor, said method including the steps of:

enclosing an electrical conductor in a coating which is capable of being treated to render the coating substantially insoluble in water and which when covered with a pulpous material comprising a water-pulp mixture is capable of being further treated to create an adhesive bond between the pulpous material and the conductor;

treating said electrical conductor which is enclosed in said coating to render the coating substantially insoluble in water;

enclosing said electrical conductor and said coating in a pulpous material having a relatively high moisture content and being disposed substantially concentrically about the conductor; and treating said coating and said pulpous material to reduce substantially the moisture content of the pulpous material and, simultaneously, to tackify the coating, which cause the crush resistance of the pulpous material to be increased so that it remains substantially concentrically disposed about the conductor and which cause the pulpous material to adhere to the conductor to form an insulative cover having substantial integrity.

2. A method of making a pulp-insulated electrical conductor, said method including the steps of:

enclosing an electrical conductor in a coating which when exposed for a predetermined time to a first temperature is partially dried to render it substantially insoluble in water and essentially non-tacky, and which when covered with pulpous material and exposed for a predetermined time to a second temperature that is substantially greater than said first temperature is further dried and tackified;

exposing said electrical conductor which is enclosed in said coating for a predetermined time to said first temperature;

enclosing said electrical conductor, which is enclosed in said coating, in an insulative cover of pulpous material having a relatively high moisture content and being disposed concentrically about the conductor; and exposing said coating and said cover of pulpous material for a predetermined time to said second temperature to reduce substantially the moisture content of the cover of pulpous material and to further dry and to tackify the coating which cause the crush resistance of the pulpous material to be increased so that it remains substantially concentrically disposed about the conductor and which cause the pulpous material to adhere to the conductor to form an insulative cover having substantial integrity.

3. The method of claim 2 wherein the first temperature is at least about 260° C. and the method further includes the step of advancing the conductor at a rate which is about 61 meters per minute.

4. The method of claim 2, wherein the second temperature is in the range of about 480° C. to 870° C.

5. The method of claim 2, wherein the coating is an aqueous emulsion of an acrylic latex copolymer.

6. The method of claim 5, wherein the coating is an ethyl acrylate-methyl acrylate copolymer.

7. The method of claim 2, wherein the moisture content of the pulp insulation is in the range of about 3 to 6% by weight.

8. The method of claim 2, wherein the first temperature is provided by infra-red heat.

9. The method of claim 2, wherein the thickness of the partially dried coating is in the range of about 0.005 mm.

* * * * *